United States Patent [19]

Duncan

[11] 4,111,262

[45] Sep. 5, 1978

[54] JUNK BOOT

[75] Inventor: Grant Duncan, Edmonton, Canada

[73] Assignee: Smith International, Inc., Newport Beach, Calif.

[21] Appl. No.: 829,603

[22] Filed: Sep. 1, 1977

[51] Int. Cl.[2] ..... E21B 31/08

[52] U.S. Cl. ..... 166/99; 166/162; 166/202; 175/308

[58] Field of Search ..... 166/99, 162, 202; 175/308, 325, 408; 294/86.34, 69 R; 73/425.2, 425.4 R

[56] References Cited

U.S. PATENT DOCUMENTS

| | | | |
|---|---|---|---|
| 1,167,670 | 1/1916 | Wheeler | 166/99 |
| 2,014,805 | 9/1935 | Hinderliter | 175/325 X |
| 2,672,199 | 3/1954 | McKenna | 166/202 X |
| 2,894,725 | 7/1959 | Baker | 166/99 X |
| 2,927,644 | 3/1960 | Caldwell | 166/99 |
| 3,102,600 | 9/1963 | Jackson | 175/308 |
| 3,419,094 | 12/1968 | Bobo | 175/325 |
| 3,467,196 | 9/1969 | Kinsman | 166/202 X |
| 3,741,301 | 6/1973 | Maly et al. | 166/202 X |
| 3,814,180 | 6/1974 | Oliver | 166/99 |

*Primary Examiner*—Ernest R. Purser
*Assistant Examiner*—Nick A. Nichols, Jr.
*Attorney, Agent, or Firm*—Robert M. Vargo

[57] ABSTRACT

A tubular, flexible rubber-like junk boot is positioned on the lower end of a drill string, blade-type stabilizer to catch small but dense particles of debris which are not removed from the hole by the drilling fluid. The boot has means on its lower end for clamping the boot in place.

4 Claims, 2 Drawing Figures

JUNK BOOT

This invention relates to earth boring or drilling operations and more particularly to an improved system for removing particles from the bottom of a drilling hole that are too dense to be removed by the drilling fluid.

In one type of oil-well drilling or other earth boring operation, a drilling fluid is circulated down through the center of a drill string onto the cutting area and then up between the drill string and the surrounding walls of the hole to carry the drill cuttings to the surface surrounding the top of the hole. Fluid circulation systems for deep drilling operations are typically designed to remove rock-chip particles up to about ¼ inch diameter. Most such rock chips will have specific gravities ranging from 2.3 to 2.6. The properties of the drilling fluid and the fluid flow velocities are maintained with a matching velocity through the annulus of the hole to provide adequate transport for particles of such density. However, particles having higher specific gravities cannot be circulated to the surface with most normal fluid densities and annular velocities unless they are somewhat smaller in size.

For example, broken teeth from steel tooth bits have a specific gravity of approximately 7.5, and portions of sintered tungsten carbide teeth have a specific gravity of 14. These particles often do not reach the top of the well unless they are no longer than three-sixteenths of an inch diameter. The particles larger than approximately three-sixteenths of an inch are circulated up the hole around the bottom hole assembly where the fluid flow characteristics are quite turbulent due to high velocities, but once reaching an area where the flow is more laminar, because of reduced velocities which result rom increased cross-sectional flow areas, through the main annulus between the drill string and the hole, they tend to settle down the hole a ways and then are circulated upwardly again. In other words, these particles tend to stay somewhat suspended in the drilling fluid until they are ground or broken into smaller particles by bit action during times when they are on bottom.

When circulation of the drilling fluid is stopped for some purpose such as making a new connection to the drilling string, the suspended particles settle rapidly and lodge on the shoulders of the drilling bit or settle to the bottom of the hole. When operations are to start again, usually the drill string is rotated before the pump circulation of the drilling fluid is reestablished. The reason for this is that the circulation is much easier once the initial gel strength of the drilling fluid has been disrupted. During this initial rotation, the hard dense junk particles on the hole bottom can become lodged between the bit cutter and the structure surrounding the base of the cutters. Particles that settle on top of the bit can be sucked into and through pressure compensation ports on bits having sealed bearings, as the bit is lowered back to the hole bottom. Tungsten carbide and steel particles have been found lodged in bearing seals, lodged in pressure compensation ports and on the interior of the bit.

In the past, steel junk subs or assemblies have often been used just above the drilling bit in holes where tungsten carbide inserts breakage has been experienced. Such assemblies are also often run preceding the use of diamond bits to insure a clean hole so that no damage will be done to the bit. Conventional, so-called junk subs, because of their inherent construction, are much more flexible then the various reamers, stabilizers and drill collars that are used in hard rock formations. Consequently, most operators and drilling contractors object to the use of conventional junk subs just above a bit in bottom hole assemblies where stiffness is required for hole straightness. Instead, in areas where considerable bit tooth breakage is encountered and a straight hole is important, stabilizer assemblies are used in the drill string, mounted as near as possible to the drill bit to best insure stability in drilling course. Thus, it is desirable that means be provided to handle the dense particles of debris in such drilling situations.

Blade stabilizers or reamer stabilizers typically have thick tubular walls to provide the desired stability and normally include a cylindrical mid section which has an outside diameter intended to engage the walls of the drill hole in order to provide the desired stabilizing action. The exterior of this enlarged portion has passages formed therein which permit the drilling fluid to pass therethrough.

In U.S. patent application Ser. No. 803,699, filed June 6, 1977, assigned to the same assignee as the present application, there is disclosed and claimed a rubber-like junk boot which is slipped on the lower end of a stabilizer to capture the particles that get part way up the annulus by means of the drilling fluid but then settle downwardly when the fluid circulation is interrupted. Positioning the junk boot directly above the drill bit and directly below the stabilizer mid-section is an ideal location in that it will best protect the drill bit and also because it is an area where many particles tend to pass when fluid circulation is interrupted. That is, fluid passing the smaller cross-sectional area of the annulus which exists at the stabilizer mid section increases its velocity with the result that many particles will pass this area but will then be suspended right above this area because of the following reduction in velocity. Hence, an area right below the stabilizer blades is a location where such particles can be conveniently caught. Such boots are, of course, useful in stabilizers further up the drill string. Again, positioning the boot right below a high velocity area is advantageous for catching particles.

Making the boot of flexible material has a number of advantages. It is less expensive than steel and can be easily installed on and removed from a conventional stabilizer so that special stabilizers of limited use need not be provided. Also, a flexible boot is not likely to catch on ledges or other obstructions in the walls of a hole as will a steel junk basket.

In accordance with the present invention, the boot is provided with an outwardly faciing groove on its lower end, and a suitable clamp fits in the groove to hold the boot against the stabilizer or other drill string member and prevent axial movement of the boot.

Preferably the boot is also formed with an inwardly extending annular rib on its lower end, which fits within an annular groove on the stabilizer or at the joint between the drill string member and another member. This arrangement further insures that axial movement is prevented.

For a more thorough understanding of the invention, refer to the following detailed description and drawings in which.

Figure 2:
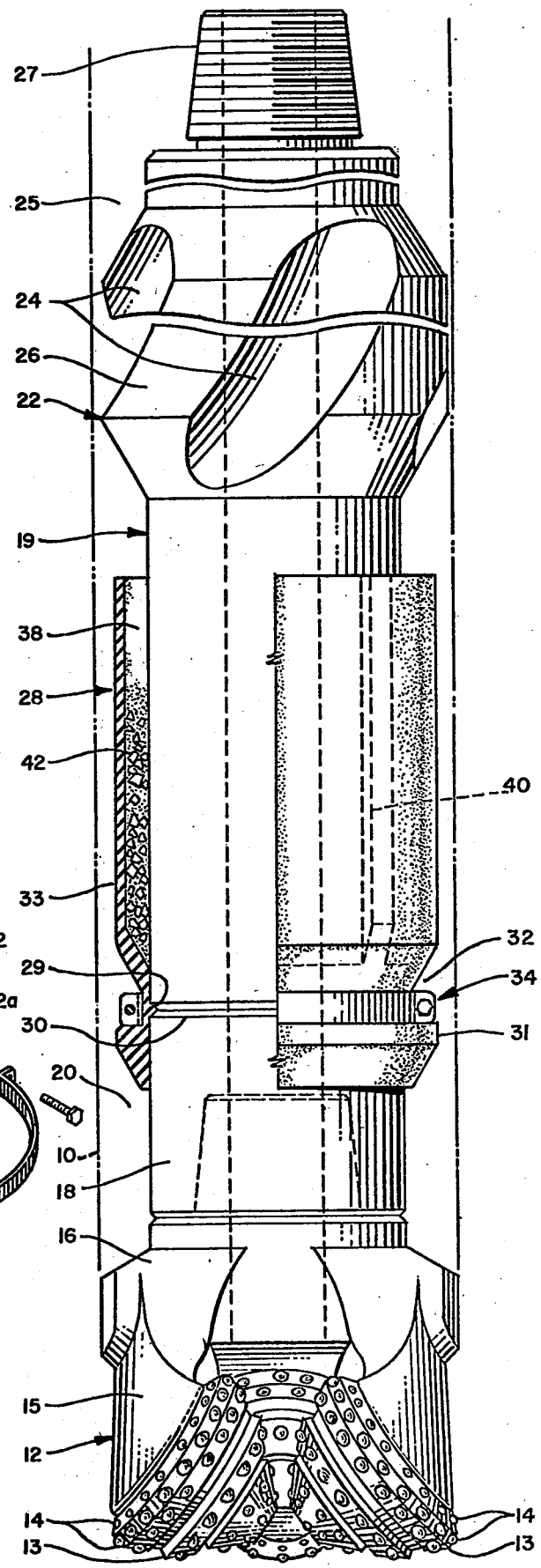
FIG. 2 is a side elevational view, partly sectionalized, illustrating the boot mounted on a stabilizer connected to a drill bit.
Figure 1:
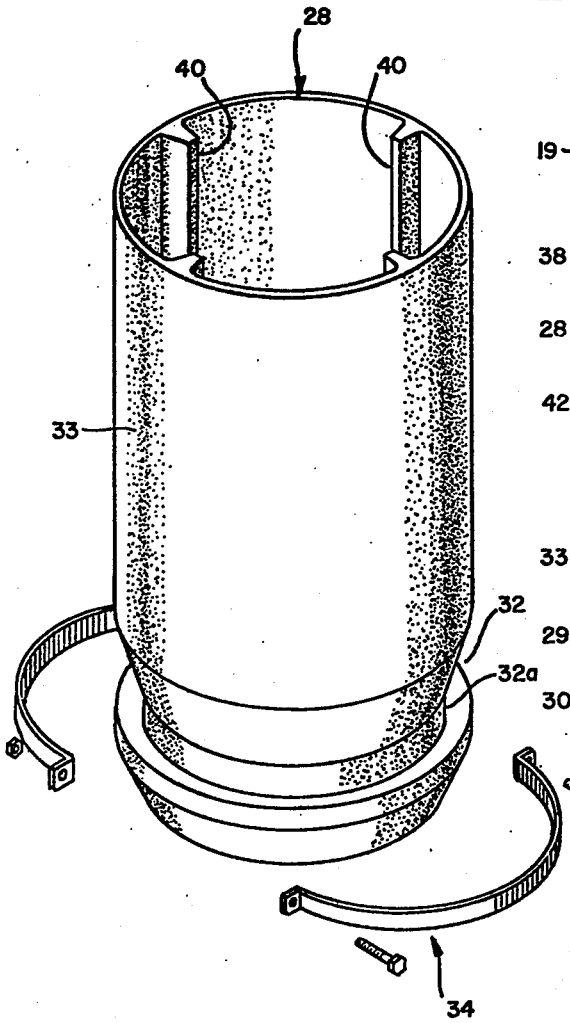
FIG. 1 is a perspective view of a molded rubber boot of the invention.

Shown in FIG. 2 are broken lines 10 which represent the walls of a drilled hole or bore formed by the drilling assembly positioned therein. On the lower end of the assembly is a drilling bit 12 having a plurality of cone shaped cutters 13 rotatably mounted on depending legs 15 of the drill bit body 16 and having tungsten carbide teeth 14. The upper end of the drill bit is attached to the lower end 18 of a stabilizer 19. The stabilizer comprises an elongated tubular member having relatively thick walls which for a rigid structure so as to minimize lateral flexing of the drill string. The lower end 18 is suitably formed for direct connection to the drilling bit 12. As can be seen, the outer diameter of the lower end 18 is somewhat smaller than the outer diameter of the drill bit and the resulting hole 10. Thus, an annular space 20 is created between the lower portion 18 and the walls 10 of the hole.

Above the lower cylindrical end 18 is an intermediate portion 22 having an outer diameter which closely fits within the walls of the hole 10 to provide lateral stability for the assembly. This intermediate portion 22 is formed with a plurality of spirally extending ribs or blades 26 which rotate in close proximity to the sides of the hole 10 to provide the desired stability. Grooves or flutes 24 between the blades 26 form passages through which fluid may pass from the annular space 20 to the similar space 25 above the intermediate portion 22 and surrounding the upper end 27 of the stabilizer.

Positioned on the lower end 18 of the stabilizer is a flexible boot 28 molded of rubber polyurethane or similar material. As can been seen, the boot has a generally tubular shape with a lower end that snugly engages the lower portion 18 of the stabilizer. More specifically,, the lower end of the boot has an annular inwardly extending rib 29 which fits within an annular groove 30 formed on the exterior of the stabilizer. The groove 30 will often be formed at the joint between two drill string components such as the stabilizer and the drill bit 12. An outwardly extending flange or lip 31 formed on the lower end of the boot defines the lower wall of a groove 32 surrounding the boot rib area. Above the cylindrical wall 32*a* of the groove 32, the boot flares outwardly to an elongated cylindrical portion 33. Clamping means 34 surround the ribbed portion of the boot engaging the wall 32*a* and thereby hold the boot securely in position on the stabilizer.

As can be seen, the outer diameter of the boot cylindrical portion is smaller than the diameter of the hole 10 so that the space 20 extends into this area and drilling fluid can flow upwardly between the boot and the hole walls. The inner diameter of the boot cylindrical portion 33 is spaced outwardly from the stabilizer lower portion 18 to define an annular space 38 closed at its lower end but open at its upper end to the space 20. Note that the upper end of the boot is spaced downwardly slightly from the enlarged fluted bladed or intermediate portion 22 of the stabilizer so that particles in the fluid can freely enter the boot.

Formed integral with the inner wall of the boot cylindrical portion 33 are a plurality of inwardly extending, but axially elongated stiffening ribs 40 which engage the stabilizer lower portion 18.

In use, as the drilling bit 12 and the stabilizer 16 are rotated, drilling fluid is circulated downwardly through the center of the stabilizer and the drill bit and onto the cutters 13. The fluid then moves upwardly between the periphery of the drill bit carrying the drill cuttings from the bottom of the hole. The fluid moves up through the annular space 20 between the stabilizer and the walls of the hole 10. In the intermediate portion 22 of the stabilizer, the fluid passes through the grooves or flutes 24.

As explained above, the stabilizer is utilized to prevent lateral movement of the drill bit, which is particularly important in hard drilling areas where precision is necessary. Because of the hardness of the material being drilled, portions of the tungsten carbide teeth shown in the drill bit occasionally break. The drilling fluid successfully carries the rock particles upwardly out of the hole as well as the smaller dense particles such as the tungsten carbide. However, the larger particles will only travel a certain distance and then be somewhat suspended in the fluid until the pump circulation is interrupted. Thus, for example, it is known that a number of particles would be suspended immediately above the entry to the boot interior space 38 or immediately above the bladed portion 22 of the stabilizer. The particles tend to hang in an area of relatively low velocity fluid flow just above a zone where the cross-sectional area of the annulus space 20 is smaller than the adjacent areas. Hence, positioning the boot below the stabilizer mid-section is an advantageous location in that when the fluid is interrupted, many of the particles 42 will settle back into the boot through its open upper end, as shown in the drawing.

When fluid circulation is continued, the particles within the boot are, of course, not disturbed, since they are not within the fluid stream. The ribs 40 on the boot prevent the boot cylindrical portion from collapsing against the stabilizer and hold the upper end open. When the stabilizer is withdrawn from the hole, the particles 42 may be removed from the boot. It is an easy operation to remove the clamping means 34 and slip the boot off the lower end of the stabilizer due to its flexibility.

Some particles may be raised up the annulus 20 much beyond the stabilizer and accordingly, the boots can be positioned on the drill string where desired. Wherever a stabilizer is positioned is a convenient location. Of course, having the boot immediately above the bit is the ideal level since it is likely to collect most falling particles. Positioning the boot on a stabilizer is the most likely arrangement since the problem of dense particles is most severe in hard formations where a stabilizer drill string is needed to obtain a straight hole; however, it should be understood that the boot can be used wherever desired. Its flexibility provides versatility in this regard.

What is claimed is:

1. A junk collector boot useful in earth boring operations comprising:

an elongated tubular body made of self-supporting, flexible, rubber-like material adapted to fit over a drill string component, such as a stabilizer, for minimizing lateral movement of the drill string, the inner wall of said body having a diameter larger than said component to define an annular space between the boot and the component, said boot having a lower end of reduced diameter to engage said component and to close the lower end of said space, with the upper end of said boot being spaced from said component to provide an entry to said space;

means for clamping the lower end of said boot to said component; and means forming an outwardly facing annular groove on the lower end of said body for receiving said clamping means, the exterior of the lower end of said body tapering outwardly to form an annular flange which forms the lower wall of said groove, said body further having a cylindrical wall above said flange forming a wall of said groove, and said body tapering outwardly and upwardly above said cylindrical wall.

2. The boot of claim 1 including an inwardly extending annular rib formed on the lower end of said body to fit within a groove formed by said component.

3. A drilling assembly comprising:

a tubular drill string component including upper and lower portions having means formed thereon for connection to other drill string components, and an intermediate portion having a diameter larger than said lower portion;

an alongated tubular boot mounted on said component lower portion with the lower end of the boot being formed to engage said lower portion, the outer diameter of said boot being less than the outer diameter of said component so that drilling fluid can flow upwardly between the boot and the surrounding drill bore, said boot having an interior cylindrical wall above said lower portion spaced from said component and open at its upper end to define a spacer for collecting debris in drilling fluid which is pumped upwardly past the boot, said debris settling into the open upper end of the boot when the pumping is interrupted, and clamping means surrounding said boot lower end to hold the boot lower end against said component and to prevent vertical movement of the boot; and said boot having means on said lower end forming an inwardly extending annular rib which fits within a groove formed by the lower portion of said component, said boot further having means on the exterior of said lower end defining an outwardly facing annular groove surrounding said rib for receiving said clamping means.

4. The assembly of claim 3 wherein the exterior of the lower end of said body tapers outwardly to form an annular flange which forms the lower wall of said groove, said body further having a cylindrical wall above said flange forming a wall of said groove, and said body tapering outwardly and upwardly above said cylindrical wall.

* * * * *